United States Patent [19]

Ralston

[11] 4,174,246

[45] Nov. 13, 1979

[54] HAND TAPING DEVICE

[75] Inventor: George D. Ralston, Bridgeview, Ill.

[73] Assignee: Natico, Inc., Chicago, Ill.

[21] Appl. No.: 818,540

[22] Filed: Jul. 25, 1977

[51] Int. Cl.[2] ..... B65B 7/28; B65B 51/06

[52] U.S. Cl. ..... 156/391; 156/69; 156/214; 156/468; 156/477 R; 156/486; 156/510; 156/522; 156/523; 156/577; 156/579

[58] Field of Search ..... 156/391, 392, 475, 477 R, 156/486, 523, 527, 579, 69, 489, 505, 506, 510, 526, 517, 468, 478, 481, 479, 40, 54, 201, 202, 214, 216, 443, 522, 577

[56] References Cited

U.S. PATENT DOCUMENTS

| | | | |
|---|---|---|---|
| 2,057,060 | 10/1936 | Schantz | 156/391 |
| 2,057,061 | 10/1936 | Eggerss | 156/391 |
| 2,591,136 | 4/1952 | Cleary et al. | 156/391 |
| 3,108,921 | 10/1963 | Gillman et al. | 156/477 R |
| 3,436,287 | 4/1969 | Windeler | 156/54 |
| 3,470,057 | 9/1969 | Stuart, Jr. et al. | 156/468 |

*Primary Examiner*—Michael G. Wityshyn

*Attorney, Agent, or Firm*—McDougall, Hersh & Scott

[57] ABSTRACT

A device for applying a pressure sensitive tape for securing covers onto drums in which means are provided for rotation of an arm about the periphery of the cover with the arm containing a pressure roller for pressing the tape into engagement with the edge of the cover as the tape is drawn from the roll about a tensioning post in response to rotation of the arm about the cover.

3 Claims, 9 Drawing Figures

Figure 8:
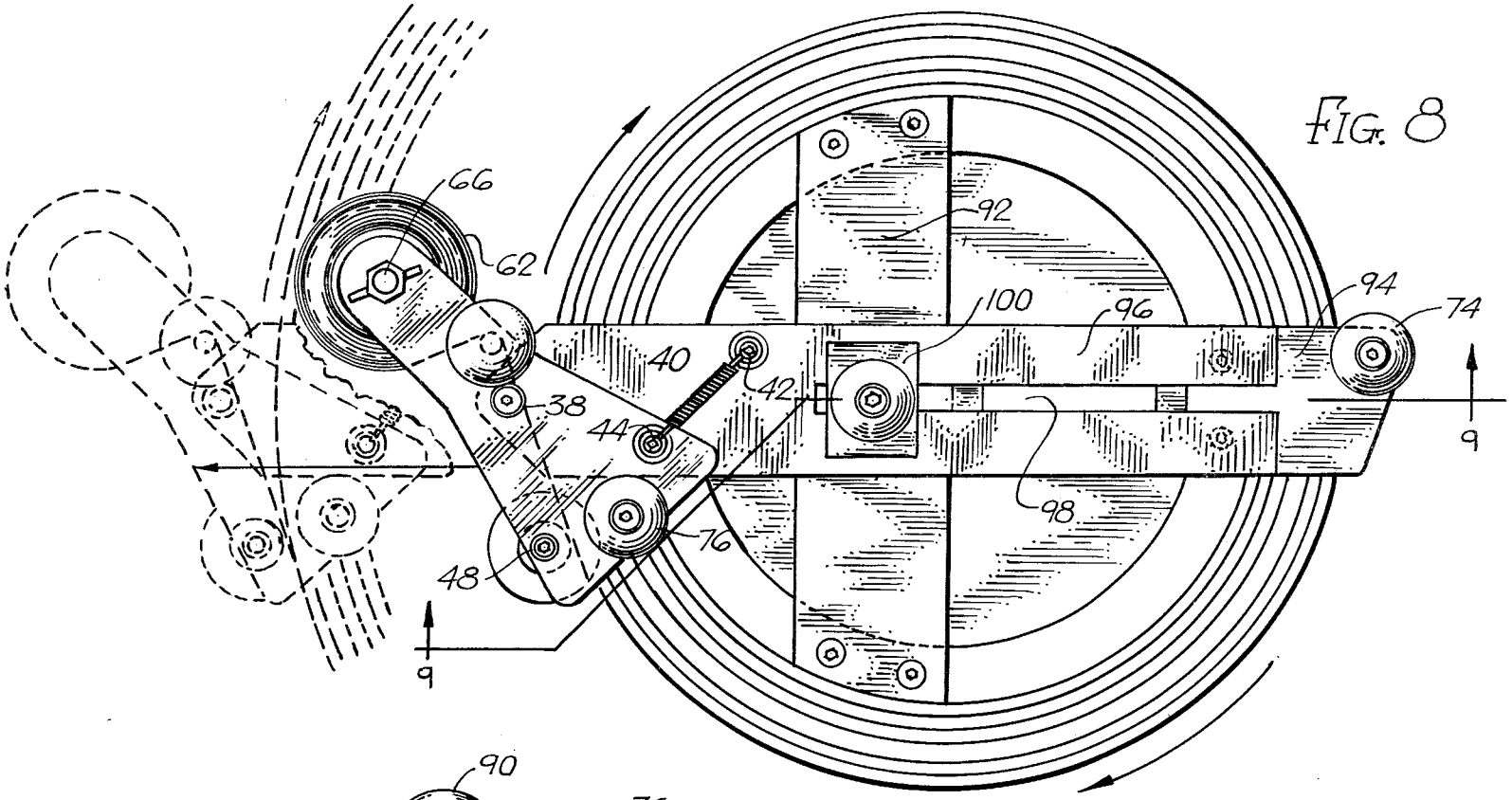

FIG. 1
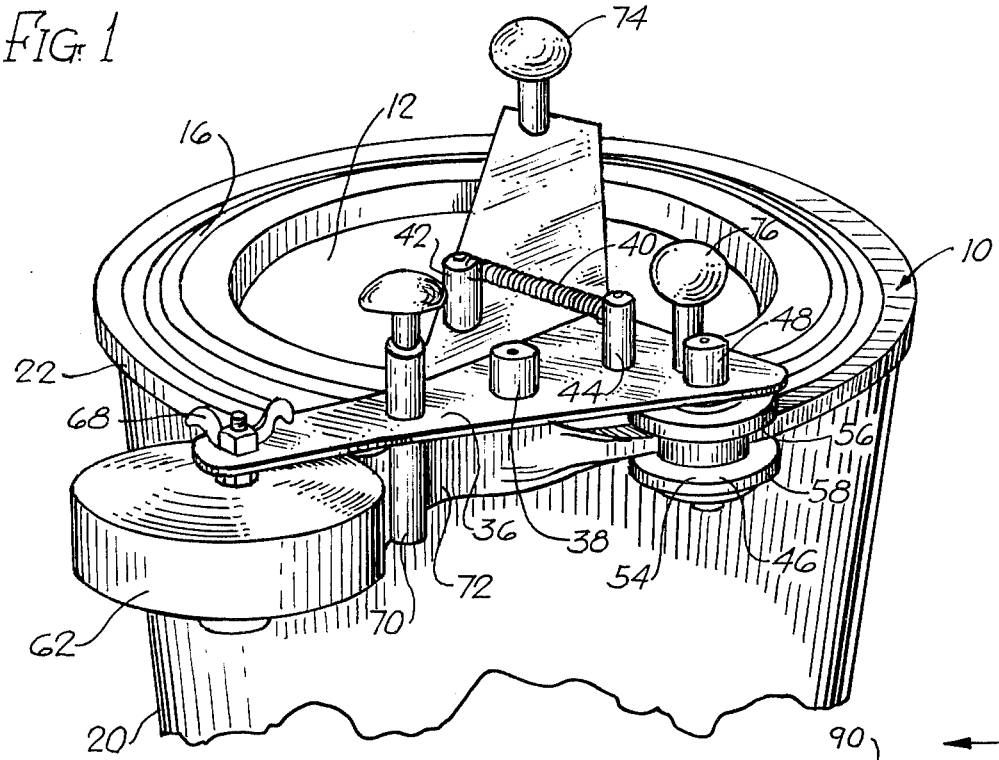
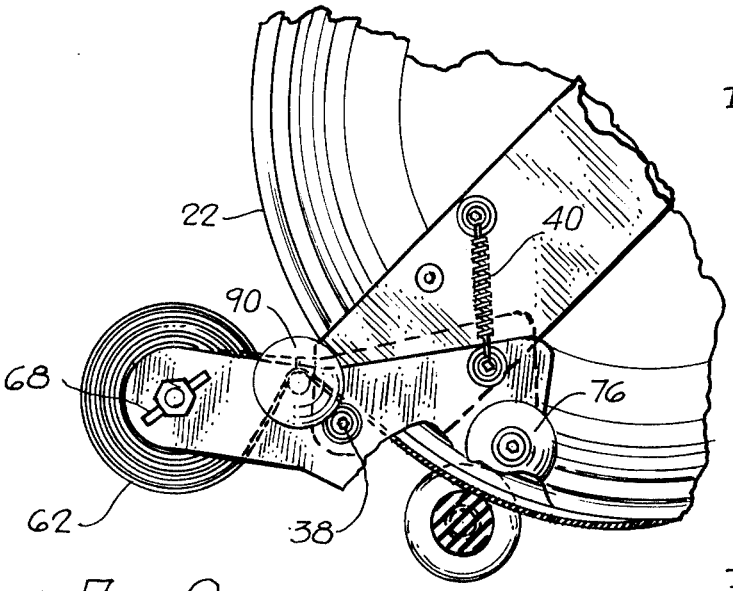
FIG. 2
FIG. 3
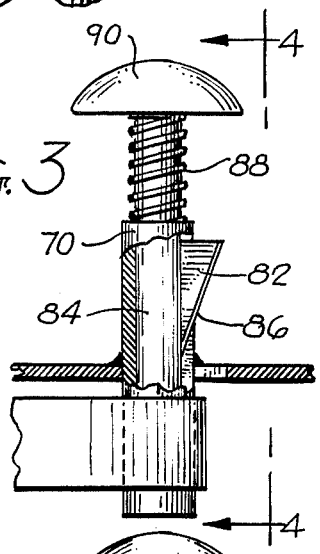
FIG. 4
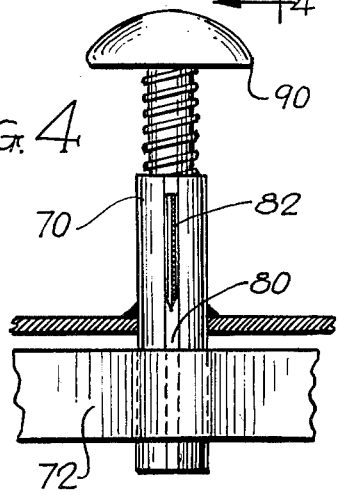

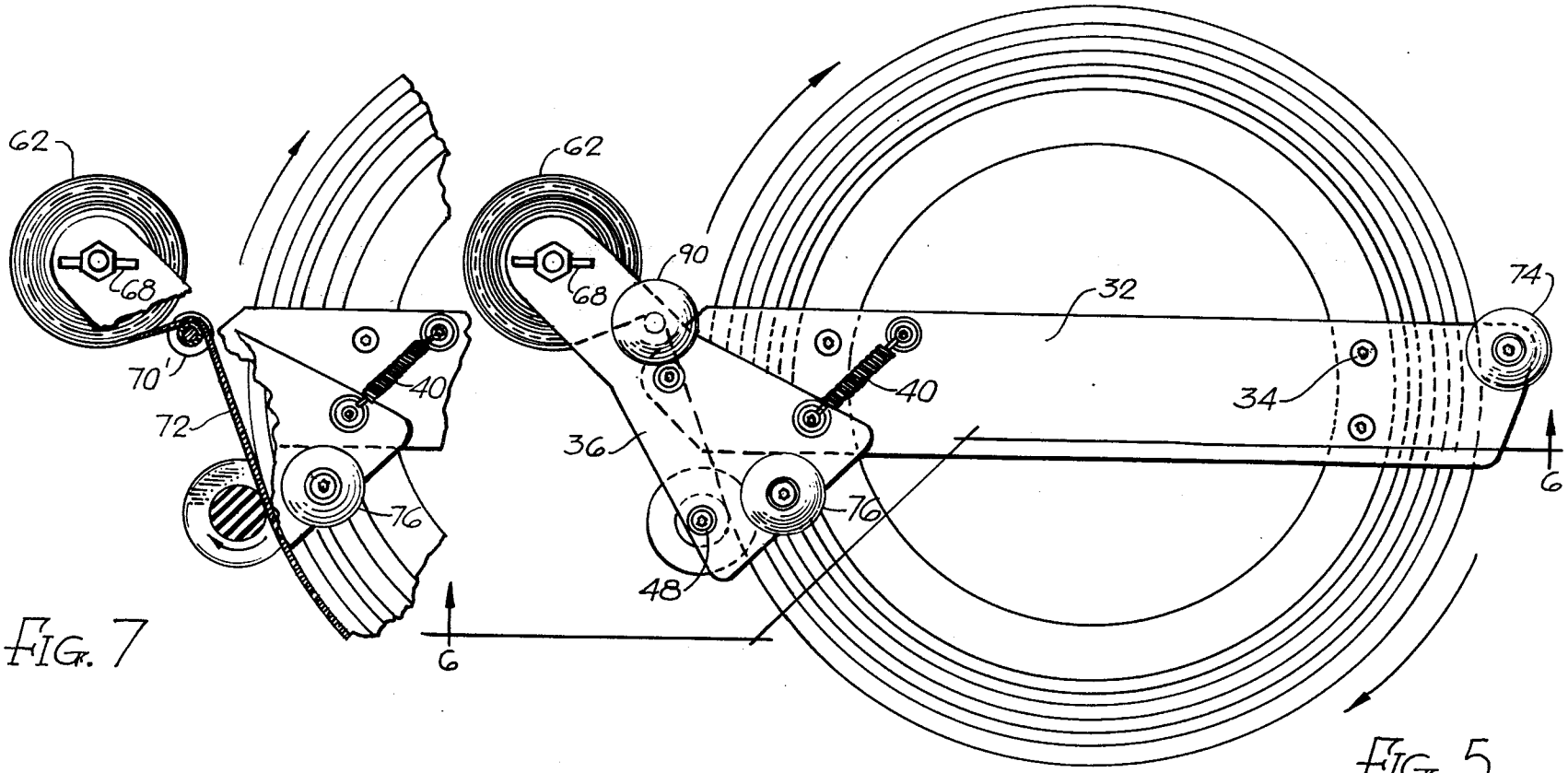
FIG. 5
FIG. 7
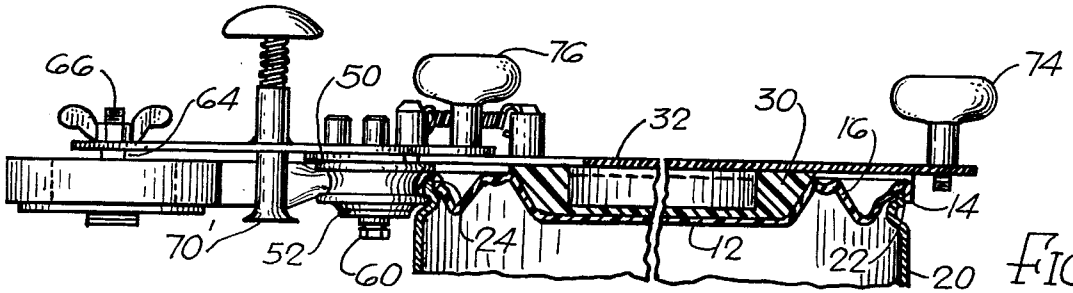
FIG. 6

HAND TAPING DEVICE

This invention relates to the taping of covers onto drums of large capacity to effect a sealing relation between the drum and cover.

By the term "drums of large capacity" is meant drums having a capacity of 5, 10, 25 and ordinarily 55 to 60 gallons. Such drums may be formed of metal but more often are formed of fiberboard spirally wound to form a cylindrical shell to which a bottom wall is secured by a chime or other configuration. Drums of the type described are used for the storage and shipment of fluids and particulate materials, which, when of a chemical nature, the drums are usually lined on the interior with a film or coating of a plastic or other protective material that is resistant to the content material and which functions as a barrier to the transmission of vapors therefrom.

After the drums are sealed, the open top end of the drum is adapted to be closed by a cover which may be formed of fiberboard or of a plastic material, with or without the underside provided with a suitable lining or coating as described above.

Generally, such covers are formed with an annular skirt which depends from the periphery resiliently to engage a flanged lip portion about the upper edge of the drum removably to secure the cover in position of use to enclose the open end of the drum. In addition, a metal band is positioned to embrace the peripheral edge portion after which the free ends are drawn circumferentially in the direction towards each other tightly to grip the cover in mounted relation on the drum. This operates firmly to secure the cover onto the drum and to enhance the sealing relation therebetween.

Such ring binders require considerable time for application and for removal. They are expensive and are easily damaged with the result that they are often limited to a single use. More importantly, they are incapable of providing a desired sealed engagement between the cover and drum.

Instead of making use of ring binders the art has sought to join the cover onto the drum by the use of binding tape. The binding tape is in the form of a flexible ribbon of plastic or coated fabric having pressure sensitive adhesive on one side. The tape is applied by hand to encircle the cover after it has been mounted in position of use on the drum. Even when great care is practiced in taping the cover onto the drum, it is difficult to maintain a steady position with the result that the amount of overlap varies from one portion of the drum to another. This detracts from the appearance and results in the formation of wrinkles which further detract from the appearance and the effectiveness of the joinder between the cover and the drum.

It is an object of this invention to provide a device which is capable of movement from drum to drum and which embodies means to enable hand taping of the cover onto the drum in a very rapid and efficient manner, without the need for skilled labor, and in which the tape is applied uniformly about the entire periphery of the drum to effect an attractive appearance as well as an effective seal between the cover and the drum, and it is a related object to provide a device of the type described which embodies flexibility to enable use with drums and covers of different sizes and capacity, independent of the composition of the drum or cover.

Figure 9:
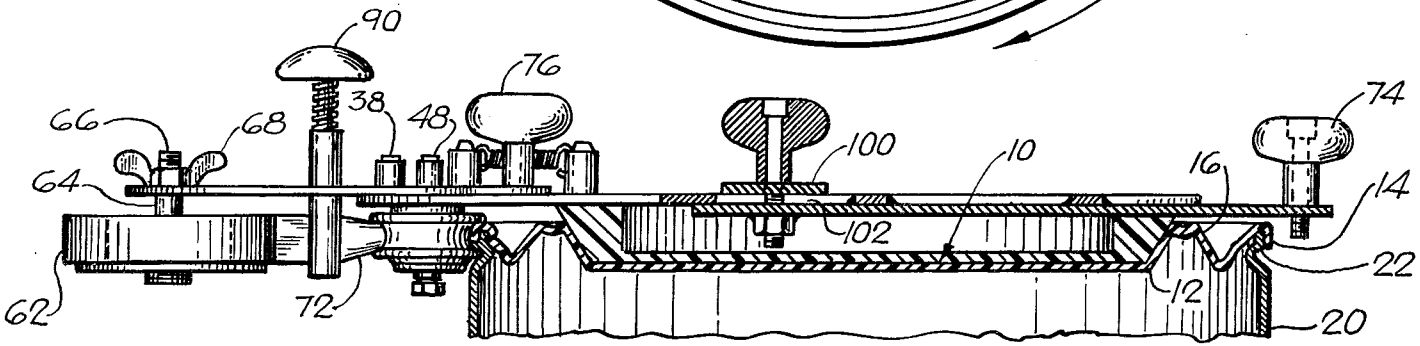

These and other objects and advantages of this invention will hereinafter appear and, for purposes of illustration but not of limitation, an embodiment of the invention is shown in the accompanying drawings in which:

FIG. 1 is a perspective elevational view of the taping device of this invention mounted in position of use on the covered drum, FIG. 2 is a top plan view of a fragmentary portion of the device shown in FIG. 1, FIG. 3 is a side elevational view, partially in section, showing the tape turning post with means for mounting a movable cutter, FIG. 4 is a front elevational view of the portion of the device shown in FIG. 3, FIG. 5 is a top plan view of a modification of the taping device of this invention, FIG. 6 is a sectional view taken along the line 6—6 of FIG. 5, FIG. 7 is a top plan view partially in section showing the movement of the tape during operation of the device, FIG. 8 is a top plan view of a further modification of a taping device embodying the features of this invention with means for adjustment to accommodate the device to drum covers of different dimensions, and FIG. 9 is a sectional view taken along the line 9—9 of FIG. 8.

The invention will be described with reference to a cover of the type shown and described in the U.S. Pat. No. 3,840,144 wherein the cover 10 is formed with a circular central body portion 12 that is separated from the annular skirt portion 14 by a circular corrugated section 16 that projects above the body portion and which serves as a guide for the taping device of this invention.

The drum 20, which may have a capacity of 5, 10, 25 or 55 gallons, is of conventional construction, having an annular lip 22 extending outwardly integrally from the top open end of the drum and which is adapted to be received in fitting relation in the annular groove 24 between the annular skirt 14 and the inner corrugated portion 16 of the cover, when the latter is placed in position of use on the drum. In the modification illustrated in the aforementioned patent, the depending skirt 14 is provided with an angular flange that extends inwardly to engage the underside of the lip 22 releasably to secure the cover in position of use on the drum. However, when use is made of a taping device of the type embodying the features of this invention, the inwardly extending lip portion can be dispensed with, since reliance can be placed on the applied tape to secure the cover onto the drum in its mounted relation. Thus the skirt 14 can terminate at or slightly above the lower edge of annular lip 22 of the drum.

The taping device comprises a circular base portion 30 molded of plastic or the like structurally strong material and which is adapted to seat within the recessed body portion 12 of the cover 10 for guided relative turning movement about the central axis of the cover as in a turntable.

A horizontally disposed base plate 32 extends substantially diametrically across the top side of the base portion 30 at a level above the cover and it is rigidly attached to the base plate, as by means of screws or bolts 34, for rotational movement therewith.

A pivot arm 36 is mounted on one end of the base plate 32 for rocking movement in a horizontal plane about a connecting pivoted pin 38 between operative and inoperative positions of adjustment. The arm 36 is constantly urged resiliently for rocking movement toward operative position, as by means of a tension spring 40 anchored at one end onto a pin 42 fixed to the top side of the base plate 32, inwardly of the arm, and at the other end on a pin 44 extending upwardly from a portion of the arm 36 offset rearwardly from the pivot 38.

A tape pressuring roller 46 is suspended from the bottom side of the base plate 36, as by means of a stub shaft 48 secured to the base plate at a portion offset rearwardly from the pivot 38 with the roller 46 mounted on a depending portion of the stub shaft for free rotational movement. Spacers 50 and 52 are provided on opposite sides of the roller 46 for positioning the tape pressuring roller in crosswise alginment with the skirt 14 of the cover and the lip 22 of the drum when the cover is in position of use on the drum. The roller is formed with a peripheral groove 54 contoured to correspond generally with the contour of the outer edge portion of the skirt and lip for engagement therewith during operation. For this purpose, the roller is formed with an annular groove 54 dimensioned to have a width corresponding to the distance between the top of the skirt 14 and the bottom of the lip 22 so that the skirt and lip will be received in substantially fitting relation within the groove when the roller is in operative position, with the annular portions 56 and 58 on each side of the groove in engagement with the top side of the skirt and the bottom side of the lip respectfully. It will be apparent that by the use of spacers 50 and 52 between the holding nut 60 on the end of the stub shaft and the bottom side of the arm 36, the level of the pressing roller 46 can be adjusted.

A tape holder is provided on a forward end portion of the arm 36 releasably to mount a roll of tape 62 at a level corresponding to the level of the tape pressing roller 46. In the illustrated modification, the roll 62 of tape is supplied as a pre-assembly on a stub shaft 64 on which it is freely rotatable, with the stub shaft having a threaded end portion 66 which extends through an opening in the arm 36 for engagement by a wing nut 68 on the extending portion releasably to secure the stub shaft in position of use on the arm. It will be understood that other means may be employed for mounting the roll 62 of tape, as by means of a stub shaft to depend from the arm 36 with a wing nut threadably engaging a threaded end portion of the lower end for releasably securing a roll of tape slipped onto and off of the stub shaft for replacement of the exhausted roll with another.

A turning post 70 is fixed to depend from the arm 36 intermediate the shaft 64 supporting the roll of tape and the shaft 48 supporting the tape pressing roller 46, with the post 70 being offset inwardly from a straight line between said shafts so that the tape 72 will be required to slide about a depending portion of the post during travel from the roll 62 to the pressure roller 46. The post 70 is intended to introduce an amount of drag on the tape as it is drawn from the roller 62.

Means such as knobs 74 and 76 are provided for actuating the turntable and plate for rotational movement about the axis of the drum whereby the applicator device is swung in a circle about the periphery of the drum. One knob 74 can be located on the far end of the plate 32 with another preferably provided to extend upwardly from a rearward end portion of the arm 32, preferably inwardly of the shaft 48, as illustrated in FIG. 1. Having described the basic elements of the device, illustration will now be made with respect to the use thereof in taping a cover onto a drum.

After the cover 10 is placed on the drum 20, the arm 32 is swung outwardly as by means of knob 76, to its inoperative position so that the base portion of the device can be seated in position of use onto the cover. Thereafter, the device is locked in position by release of the knob 76 which enables the spring 40 to rock the arm 36 about the pivot to operative position with the pressure roller 46 urged under spring pressure into engagement with the outer surface of the skirt 14.

The end of the tape 72 is started by pressing the end onto a small segment of the vertical edge of the cover whereby the pressure sensitive adhesive on the engaged surface of the tape bonds the end portion to the cover. Thereafter the turntable is merely rotated through an angle of 360°. As the turntable rotates, the end of the tape sticking to the drum will pull the tape from the roll 62 for passage about the post 70 to the skirt 14 where the pressure roller 46 comes into engagement with the tape to wrap it about the skirt portion 14 and lip 22 and more or less to iron the tape onto the engaged surfaces. The tape 72 is peeled from the roller so that the backside engages the post 70 while the side with the pressure sensitive adhesive faces in the direction of the lip 14 so that it will become bonded to the lip as the roller 46 presses it into engagement therewith.

When the encirclement is completed, the tape 72 is cut, the arm 36 is rocked to inoperative position to free the pressure roller 46 from the cover, and the unit is removed. The result is a continuous tape applied under pressure, in a uniform manner, about the edge of the cover and drum to secure the cover to the drum.

It will be apparent that the activating means for rotational movement of the device can be mechanized or that the knob can be located both on the base member or base plate or that the other knob 76 can be located in other portions of the arm 36, but it is preferred to locate the other knob 76 alongside the pressure roller 46 and inwardly thereof so that the force applied to the knob for effecting rotational movement of the device about the cover contributes to the force effective on the tape pressing roller to bond the tape onto the cover and drum. Though not essential, it is preferred to provide a post 70 with an outwardly flared end portion 70', as shown in FIG. 6, whereby the flared end portion of the post is capable of initiating the inward turning movement of the lower end portion of the tape thereby to enhance the control of the wrap of the tape about the vertical outer edge of the cover and the entrance of the tape into the grooved portion of the tape pressure roller 46.

By way of further modification, instead of cutting the tape as by means of a scissors, knife or the like after the taping operation has been completed, cutoff means can be incorporated into the device for severing the tape. Such cutoff means are preferably incorporated into the turning post 70 since it represents a stationery element and because cutoff at the post will make it easier to grasp the free end of the tape to bond the end onto the vertical edge of the cover to initiate the taping operation. For this purpose, the post 70 is in the form of a sleeve section having a vertical slot 80 extending from below the portion on which the tape 72 rides to above the tape to accommodate a knife 82 which extends through the slot from a rod 84 which is mounted for axial sliding movement within the sleeve 70. The knife edge 86 extends angularly outwardly from the lower edge of the slot to cut the tape as the knife is actuated from its raised position, clear of the tape, to its lowered position, across the tape. The knife 82 and rod 84 is resiliently urged to its raised position as by means of a coil spring 88 which encircles the rod 84 with one end in engagement with the top of the sleeve 70 while the other end is in engagement with the bottom side of a button 90 on the projecting upper end of the rod 84. Thus, when the taping operation is completed and it is desired to cut the tape, it is only necessary to push down on the button 90 for displacement of the knife edge through the tape, with the knife automatically returning to its raised position upon release, in response to the pressure from the coil spring 88.

The modification shown in FIGS. 8 and 9 illustrates the flexibility that can be incorporated into the device wherein the turntable base portion can be replaced by a side arm 92 which extends into engagement with grooves in the cover to guide the device during rotational movement relative to the cover, and wherein the base plate 32 can be formed of two or more segments 94 and 96 with means releasably to secure the segments one to the other for varying the span to accommodate covers of different sizes.

In the illustrated modification, one segment 96 is formed with an elongate slot 98 while the other is provided with a plate 100 which is capable of displacement through an opening 102 in the segment 96 into engagement therewith to secure the segment one to the other in lengthwise adjustment.

Rotational movement of the base plate about the central axis of the drum can be controlled other than by the turntable concept embodying the circular base member adapted to seat in fitting relation in a depressed circular portion of the cover. Thus the hand taping device can be adapted for use with covers which may not embody such circular guide means. For example, the base plate can be provided with a pivot pin which extends downwardly from a portion of the base plate aligned with the axis of the drum to engage the top side of the cover as a pivot point. Instead, the base plate can be provided with rollers which depend from spaced apart portions of the base plate to engage the periphery of the cover for guiding the base plate during rotational movement on the cover.

It will be understood that changes may be made in the details of construction, arrangement and operation, without departing from the spirit of the invention, especially as defined in the following claims.

I claim:

1. A device for taping a cover onto a drum comprising a base plate and means mounting the base plate on the cover for rotational movement on an axis corresponding to the axis of the cover, an arm pivotally mounted on the base plate for rocking movement relative to the base plate, a pressure roller mounted on the arm for free rotational movement, a tape supply roll support mounted on the arm for free rotational movement of a supply roll, a guide post fixed to the arm intermediate the support and the pressure roller and offset inwardly towards the periphery of the cover from a line between the axes of said support and pressure roller so that the tape comes into engagement with the guide post during passage from the supply roll to the pressure roller, and means constantly urging the arm for rocking movement about its pivot in a direction to displace the pressure roller inwardly towards the periphery of the cover, in which the guide post depends from the arms and in which the lower end portion of the guide post is formed with an outward flare to preform the tape as it is drawn thereover.

2. A device for taping a cover onto a drum comprising a base plate and means mounting the base plate on the cover for rotational movement on an axis corresponding to the axis of the cover, an arm pivotally mounted on the base plate for rocking movement relative to the base plate, a pressure roller mounted on the arm for free rotational movement, a tape supply roll support mounted on the arm for free rotational movement of a supply roll, a guide post fixed to the arm intermediate the support and the pressure roller and offset inwardly towards the periphery of the cover from a line between the axes of said suppport and pressure roller so that the tape comes into engagement with the guide post during passage from the supply roll to the pressure roller, means constantly urging the arm for rocking movement about its pivot in a direction to displace the pressure roller inwardly towards the periphery of the cover and means for cutting the tape, in which the cutting means is incorporated in the guide post and comprises a guide post in the form of a hollow sleeve section, a rod mounted for axial movement in the sleeve section between raised and lowered positions of adjustment with a portion of the rod extending above the sleeve section, a knife extending outwardly from the rod through an elongate slot in the sleeve section, means constantly urging the rod towards raised position whereby the knife is out of alignment with the portion of the rod engaged by the tape, and means for actuating the rod from raised to lowered position to sever the portion of the tape in engagement with the post.

3. A device as claimed in claim 2, in which the means constantly urging the rod towards raised position comprises spring means interposed between the projecting portion of the rod and the sleeve.

* * * * *